US008662086B2

(12) United States Patent
Kesselman

(10) Patent No.: US 8,662,086 B2
(45) Date of Patent: Mar. 4, 2014

(54) RECLOSABLE PACKAGE WITH MAGNETIC CLASP FOR ROLLING PAPERS USED IN SMOKING ARTICLES

(75) Inventor: Joshua D. Kesselman, Phoenix, AZ (US)

(73) Assignee: BBK Tobacco & Foods, LLP, Phoenix, AZ (US)

( * ) Notice: Subject to any disclaimer, the term of this patent is extended or adjusted under 35 U.S.C. 154(b) by 0 days.

(21) Appl. No.: 12/714,230

(22) Filed: Feb. 26, 2010

(65) Prior Publication Data

US 2010/0206757 A1 Aug. 19, 2010

Related U.S. Application Data

(63) Continuation-in-part of application No. 11/671,892, filed on Feb. 6, 2007, now abandoned.

(51) Int. Cl.
*A24C 1/28* (2006.01)

(52) U.S. Cl.
USPC ..... 131/105; 206/494; 206/237; 206/440

(58) Field of Classification Search
None
See application file for complete search history.

(56) References Cited

U.S. PATENT DOCUMENTS

| | | | | |
|---|---|---|---|---|
| 266,439 | A | 10/1882 | Daniels, Jr. | |
| 1,145,268 | A | 7/1915 | Rossy | |
| 1,452,993 | A | 4/1923 | Wack | |
| 1,479,458 | A | 1/1924 | de la Mota | |
| 1,631,048 | A | 5/1927 | Miller | |
| 1,670,343 | A | 5/1928 | Clemens | |
| 1,983,530 | A | 12/1934 | Bradenberger | |
| 1,995,068 | A | 3/1935 | Lim | |
| 2,125,618 | A | 8/1938 | Nystrand | |
| 2,170,147 | A | 8/1939 | Lane | |
| 2,202,322 | A | 5/1940 | Scull | |
| 2,427,957 | A | 9/1947 | Getts | |
| 3,395,714 | A | 8/1968 | Kahane | |
| 3,586,005 | A | 6/1971 | Lippman, Jr. et al. | |
| 3,692,176 | A | 9/1972 | Templeton et al. | |
| 3,749,301 | A * | 7/1973 | Peckar | 229/125.37 |
| D243,350 | S | 2/1977 | Shibata | |
| 4,033,358 | A | 7/1977 | Harrington | |

(Continued)

FOREIGN PATENT DOCUMENTS

| | | | |
|---|---|---|---|
| BE | 485679 A | | 11/1948 |
| BR | 9804420 A | * | 5/2000 |

(Continued)

OTHER PUBLICATIONS http://en.wikipedia.org/wiki/Neodymium_magnet.*

(Continued)

*Primary Examiner* — Richard Crispino
*Assistant Examiner* — Phu Nguyen
(74) *Attorney, Agent, or Firm* — Weiss & Moy, P.C.; Jeffrey D. Moy

(57) ABSTRACT

A recloseable package for containing smoking papers to be dispensed therefrom, the package comprising: a body for holding the smoking papers, the body having a cover which overlays the body of the package for closure, wherein the cover has a first magnet, and wherein the body has a second magnet, the first and second magnets being positionally mounted to contact one another when the cover is folded downwardly over the body of the package for closure.

10 Claims, 2 Drawing Sheets

(56) References Cited

U.S. PATENT DOCUMENTS

| | | | | |
|---|---|---|---|---|
| 4,104,431 | A | 8/1978 | Luke | |
| 4,146,041 | A | 3/1979 | Laszlo | |
| 4,235,189 | A | 11/1980 | Severin | |
| 4,290,592 | A | 9/1981 | Kastner | |
| 4,435,202 | A | 3/1984 | Koizumi et al. | |
| 4,436,202 | A | 3/1984 | Berkley | |
| D277,034 | S | 1/1985 | Ramsdell | |
| D279,507 | S | 7/1985 | Schechter et al. | |
| 4,593,736 | A * | 6/1986 | Morita | 150/147 |
| 4,700,840 | A | 10/1987 | Haddock | |
| 4,738,390 | A * | 4/1988 | Brennan | 229/77 |
| D296,938 | S | 7/1988 | Ameringen | |
| 4,775,358 | A | 10/1988 | Jones | |
| 4,832,057 | A | 5/1989 | Bale et al. | |
| 4,902,361 | A * | 2/1990 | Lee et al. | 148/302 |
| 5,080,223 | A | 1/1992 | Mitsuyama | |
| 5,094,253 | A | 3/1992 | St. Charles et al. | |
| 5,118,554 | A | 6/1992 | Chan et al. | |
| 5,284,166 | A | 2/1994 | Cartwright et al. | |
| 5,387,108 | A | 2/1995 | Crowell | |
| 5,445,199 | A | 8/1995 | Jia | |
| 5,462,070 | A | 10/1995 | Rahardja | |
| 5,464,073 | A | 11/1995 | Johannes | |
| 5,609,269 | A | 3/1997 | Behnke et al. | |
| 5,613,958 | A | 3/1997 | Kochinke et al. | |
| 5,645,089 | A | 7/1997 | Burger et al. | |
| 5,657,773 | A | 8/1997 | George | |
| 5,697,127 | A | 12/1997 | Tyler | |
| 5,713,406 | A | 2/1998 | Drury | |
| 5,752,589 | A * | 5/1998 | Berg | 190/109 |
| 5,762,074 | A * | 6/1998 | Garner | 131/360 |
| 5,782,246 | A | 7/1998 | Axelrod | |
| 5,873,166 | A | 2/1999 | Page | |
| 5,927,488 | A * | 7/1999 | Gray | 206/237 |
| 5,970,777 | A | 10/1999 | Hunt et al. | |
| 6,000,404 | A | 12/1999 | Case et al. | |
| 6,041,921 | A | 3/2000 | Staiano et al. | |
| D432,263 | S | 10/2000 | Issa | |
| 6,164,443 | A | 12/2000 | Mitchell et al. | |
| D438,105 | S | 2/2001 | Conner et al. | |
| 6,357,448 | B1 | 3/2002 | Sinclair, Jr. | |
| 6,427,836 | B1 | 8/2002 | Bolanos | |
| 6,446,793 | B1 | 9/2002 | Layshock | |
| 6,526,986 | B1 | 3/2003 | Sinclair, Jr. | |
| 6,571,803 | B1 | 6/2003 | Bregeard | |
| 6,638,613 | B1 | 10/2003 | Bland | |
| 6,742,525 | B2 | 6/2004 | Sinclair, Jr. | |
| 6,758,906 | B2 | 7/2004 | Maiwald et al. | |
| D499,019 | S | 11/2004 | Sagmeister et al. | |
| 6,854,471 | B1 | 2/2005 | Sinclair, Jr. | |
| 6,920,865 | B2 | 7/2005 | Lyon | |
| 6,920,885 | B2 | 7/2005 | Braun | |
| 7,048,115 | B2 | 5/2006 | Stringfield | |
| D526,086 | S | 8/2006 | Mehta | |
| 7,097,896 | B2 | 8/2006 | Merrill | |
| 7,136,288 | B2 | 11/2006 | Hoogerdijk | |
| 7,172,672 | B2 | 2/2007 | Silverbrook | |
| D541,471 | S | 4/2007 | Mitten et al. | |
| 7,282,249 | B2 | 10/2007 | Harrison et al. | |
| D558,199 | S | 12/2007 | Fiorentino | |
| 7,334,725 | B2 | 2/2008 | Dan | |
| 7,335,725 | B2 | 2/2008 | Hill et al. | |
| 7,344,072 | B2 | 3/2008 | Gonzalez et al. | |
| 7,455,176 | B2 | 11/2008 | Focke et al. | |
| 2002/0083952 | A1 | 7/2002 | Braun | |
| 2004/0083552 | A1 | 5/2004 | Abrahall | |
| 2005/0072437 | A1 | 4/2005 | Gomez | |
| 2005/0072439 | A1 | 4/2005 | Darwish | |
| 2005/0174004 | A1 * | 8/2005 | Takehara et al. | 310/156.43 |
| 2006/0000481 | A1 | 1/2006 | Sinclair | |
| 2006/0037622 | A1 | 2/2006 | Bachmann | |
| 2006/0083886 | A1 | 4/2006 | Harrison et al. | |
| 2006/0150991 | A1 | 7/2006 | Lee | |
| 2007/0062967 | A1 | 3/2007 | Zaidman et al. | |
| 2007/0062968 | A1 | 3/2007 | Mark et al. | |
| 2007/0062976 | A1 | 3/2007 | Blum et al. | |
| 2007/0221528 | A1 * | 9/2007 | Bobe et al. | 206/494 |
| 2008/0308431 | A1 | 12/2008 | Kesselmann et al. | |
| 2011/0030710 | A1 | 2/2011 | Kesselman | |

FOREIGN PATENT DOCUMENTS

| | | | |
|---|---|---|---|
| CA | 2243807 | A1 | 1/2000 |
| DE | 3300302 | A1 | 7/1984 |
| DE | 9414404 | U1 | 2/1995 |
| DE | 29502062 | U1 | 6/1996 |
| DE | 19531061 | A1 | 2/1997 |
| DE | 29702285 | U1 | 4/1997 |
| DE | 29722293 | U1 | 3/1998 |
| DE | 20317744 | U1 | 4/2004 |
| DE | 202004007772 | U1 | 10/2004 |
| EP | 0934703 | A1 | 8/1999 |
| EP | 1155974 | A1 | 11/2001 |
| EP | 1382264 | A1 | 1/2004 |
| EP | 2016841 | A2 | 1/2009 |
| FR | 646187 | A | 11/1928 |
| FR | 2767033 | A1 | 2/1999 |
| GB | 26448 | | 0/1913 |
| GB | 2318992 | A | 5/1998 |
| GB | 2336989 | | 11/1999 |
| WO | WO-97/25885 | A1 | 7/1997 |
| WO | WO-97/25886 | A1 | 7/1997 |
| WO | WO-98/20757 | | 5/1998 |
| WO | WO-03/020057 | A | 3/2003 |
| WO | WO-2004/056661 | A2 | 7/2004 |
| WO | WO-2006/111956 | A2 | 10/2006 |
| WO | WO-2010/144063 | A1 | 12/2010 |

OTHER PUBLICATIONS http://en.wikipedia.org/wiki/Neodymium_magnet Date: Unknown.*

Final Rejection U.S. Appl. No. 29/261,575, filed Nov. 6, 2008.

Guide to patent drawings, Symbol used for indicating a transparent surface, 1993.

Office Action dated May 14, 2007 U.S. Appl. No. 10/922,048, filed Aug. 19, 2004.

Office Action dated Feb. 25, 2009 U.S. Appl. No. 11/746,503, filed May 9, 2007.

Office Action dated Feb. 23, 2009 U.S. Appl. No. 11/763,865, filed, Jun. 15, 2007.

Office Action dated Mar. 3, 2009 U.S. Appl. No. 11/778,305, filed Jul. 14, 2007.

Non-Final Rejection U.S. Appl. No. 29/258,924, filed Oct. 30, 2007.

Office Action dated Feb. 15, 2008 U.S. Appl. No. 29/261,575, filed Jun. 14, 2006.

Republic Tobacco's Tribal Hemp extra sheer papers—http://web.archive.org/web/20020609062512/www.ryomagazine.com/papers.htm, date 2002.

Written Opinion 04/029882, received Apr. 19, 2005.

Notice of Allowability for Design U.S. Appl. No. 29/323,269, filed Aug. 21, 2008.

European Search Report dated Dec. 17, 2009, EP App. No. 09168276.5.

Office Action dated Dec. 23, 2009 for U.S. Appl. No. 29/335,083, filed Apr. 8, 2009.

Office Action dated Jan. 26, 2010 for co-pending U.S. Appl. No. 11/763,865.

Office Action dated Oct. 15, 2010, U.S. Appl. No. 11/763,865, filed Jun. 15, 2007.

Office Action dated May 27, 2011, U.S. Appl. No. 12/196,019, filed Aug. 21, 2008.

European Search Report dated Oct. 8, 2008 for EP 08010433.4, filed Jun. 9, 2008.

Office Action, dated Nov. 8, 2011 for U.S. Appl. No 12/196,019, filed Aug. 21, 2008.

European Search Report, dated Sep. 14, 2011, EP App. No. EP11166601.2.

Office Action dated Jan. 9, 2012 for U.S. Appl. No. 12/392,558, filed Feb. 25, 2009.

(56) References Cited

OTHER PUBLICATIONS

Office Action dated Mar. 13, 2012 U.S. Appl. No. 12/884,728, filed Sep. 17, 2010.
How to roll your own cigarettes, www.ryoguide.com, downloaded Dec. 2009.
EP Search Report (partial) dated Dec. 15, 2011 for EP 11181430.7 filed Sep. 15, 2011.
Response dated Jan. 26, 2010 to Office Action dated Dec. 23, 2009 U.S. Appl. No. 29/335,083, filed Apr. 8, 2009.
Response dated Aug. 15, 2008 to Office Action dated Feb. 15, 2008 U.S. Appl. No. 29/261,575.
Response—Pre Appeal Brief dated Feb. 23, 2009 U.S. Appl. No. 29/261,575, filed Jun. 14, 2006.
Office Action dated Jun. 17, 2009 U.S. Appl. No. 29/261,575, filed Jun. 14, 2006.
Response—Appeal Brief dated Oct. 16, 2009 U.S. Appl. No. 29/261,575, filed Jun. 14, 2006.
Office Action dated Jan. 5, 2010 (Answer to Appeal Brief filed Oct. 16, 2009) U.S. Appl. No. 29/261,575, filed Jun. 14, 2006.
Response—Reply to Examiners Reply dated Mar. 4, 2010 U.S. Appl. No. 29/261,575, filed Jun. 14, 2006.
Office Action dated Oct. 6, 2011 U.S. Appl. No. 12/392,558, filed Feb. 25, 2009.
Response dated Oct. 19, 2011 to Office Action dated Oct. 6, 2011 U.S. Appl. No. 12/392,558, filed Feb. 25, 2009.
Response dated Sep. 16, 2011 to Office Action dated May 27, 2011 U.S. Appl. No. 12/196,019, filed Aug. 21, 2008.
Response dated Dec. 29, 2011 (CPA/RCE) dated Dec. 19, 2011 to Office Action dated Nov. 8, 2011 U.S. Appl. No. 12/196,019, filed Aug. 21, 2008.
Response dated Aug. 16, 2007 to Office Action dated May 14, 2007 U.S. Appl. No. 10/922,048, filed Aug. 19, 2004.
Response dated May 22, 2009 to Office Action dated Feb. 25, 2009 U.S. Appl. No. 11/746,503, filed May 9, 2007.
Office Action (final) dated Aug. 20, 2009 U.S. Appl. No. 11/746,503, filed May 9, 2007.
Office Action dated Aug. 27, 2009 U.S. Appl. No. 11/671,892, filed Feb. 6, 2007.
Response dated Jul. 9, 2009 to Office Action dated Mar. 3, 2009 U.S. Appl. No. 11/778,035, filed Jul. 14, 2007.
Office Action dated Nov. 30, 2009 U.S. Appl. No. 11/778,035, filed Jul. 14, 2007.
Response dated May 22, 2009 to Office Action dated Feb 23, 2009 U.S. Appl. No. 11/763,865, filed Jun. 15, 2007.
Office Action dated Aug. 3, 2009 U.S. Appl. No. 11/763,865, filed Jun. 15, 2007.
Response dated Sep. 28, 2009 to Office Action dated Aug. 3, 2009 U.S. Appl. No. 11/763,865, filed Jun. 15, 2007.
Office Action (advisory) dated Oct. 8, 2009 U.S. Appl. No. 11/763,865, filed Jun. 15, 2007.
Response (RCE) dated Oct. 27, 2009 to Office Action dated Aug. 3, 2009 U.S. Appl. No. 11/763,865, filed Jun. 15, 2007.
Response dated Jun. 28, 2010 to Office Action dated Jan. 26, 2010 U.S. Appl. No. 11/763,865, filed Jun. 15, 2007.
Office Action (noncompliant) dated Jul. 9, 2010 U.S. Appl. No. 11/763,865, filed Jun. 15, 2007.
Response dated Aug. 5, 2010 to Office Action dated Jan. 26, 2010 U.S. Appl. No. 11/763,865, filed Jun. 15, 2007.
Response (appeal brief) dated Apr. 8, 2011 to Office Action dated Oct. 15, 2010 U.S. Appl. No. 11/763,865, filed Jun. 15, 2007.
Office Action (defective brief) dated Apr. 22, 2011 U.S. Appl. No. 11/763,865, filed Jun. 15, 2007.
Response (substitute appeal bried) dated May 13, 2011 to Office Action dated Oct. 15, 2010 U.S. Appl. No. 11/763,865, filed Jun. 15, 2007.
Office Action (examiner's answer) dated Aug. 3, 2011 U.S. Appl. No. 11/763,865, filed Jun. 15, 2007.
Response (reply brief) dated Sep. 26, 2011 to Office Action dated Aug. 3, 2011 U.S. Appl. No. 11/763,865, filed Jun. 15, 2007.

* cited by examiner

RECLOSABLE PACKAGE WITH MAGNETIC CLASP FOR ROLLING PAPERS USED IN SMOKING ARTICLES

CROSS REFERENCE TO RELATED APPLICATIONS

This application is a continuation-in-part of U.S. application Ser. No. 11/671,892, filed on Feb. 6, 2007, entitled INTERLEAVED TRANSPARENT CELLULOSE PAPER WITH OPAQUE ADHESIVE.

BACKGROUND OF THE INVENTION

1. Field of the Invention

This invention is related in general to the field of products used by an end user to create their own cigars or cigarettes. More particularly, the invention is related to a reclosable package with magnetic clasp for rolling papers used in roll your own smoking articles.

2. Discussion of the Background

Materials or papers used for rolling smoking articles, such as cigars or cigarettes, may be made from a variety of materials such as reconstituted tobacco and paper. Typically such papers or "leaves" absorb saliva or have an edge coated with adhesive for sealing the rolled smoking article. Another product utilizes highly transparent cellulose paper, which can be made from cellulose of wood, cotton, or hemp that is blended with glycerin or a glycerin alternative, and water. Such cellulose paper, hereinafter interchangeably used with term cellophane, is appealing because it has no taste or odor, is highly transparent, and it allows a slower combustion without changing the characteristics of the smoking materials. However, the transparent cellulose wrapping papers that are currently available do not adequately adhere to themselves when rolled for smoking purposes.

A further limitation is that cellophane is water-resistant and is not capable of absorbing liquids. Hence, it docs not absorb saliva and will not stick even when moistened in such a manner. Furthermore, upon application the standard acacia gum commonly used with rolling materials simply runs off of the cellophane sheets, thus impairing the ability to impart a workable adhesive area to the rolling paper. The characteristic of being non-absorbent further limits the type of packaging that can be utilized for a plurality of interleaved sheets. Not only must the adhesive adhere to each sheet upon application, but the adhesive must also be retained on each sheet upon removal from the pack for use.

In addition, another deficiency of the prior art is the inadequate closure of the package or box of papers. The prior art packages fail to remain closed, and with routine use, they become worn, remaining open even more easily. When carrying the pack of papers in a pocket or purse, the package tends to open, allowing the papers to fall out and become damaged. Furthermore, an open package exposes the other leaves to the elements, or it causes the pack to become crushed or deformed if it is quickly inserted into one's pocket. In other words, the cover can become deformed if the smoker does not purposefully hold the pack closed during its insertion into a pocket or case.

These limitations tend to frustrate the purpose of wrapping materials, that is, to permit the smoker to individually roll cigarettes and other smoking articles with a sheet that firmly adheres when rolled, and to provide the consumer with a convenient pack that allows each transparent sheet to be easily dispensed in a rollable condition. Hence, it would be desirable to provide a suitable package for rolling papers that provides a reliable and secure closure so that the leaves do not slip out, as well as including a tamper-resistant seal for ensuring a factory-fresh product. It would also be desirable to provide a means for assembling cellulose rolling paper into a convenient interleaved stack that permits retention of the adhesive on each sheet as it is removed the package.

The use of adhesive on reconstituted tobacco sheets for rolling tobacco products is well-known in the art. Tobacco sheets for rolling tobacco products are disclosed in Garner, U.S. Pat. No. 5,762,074, which provides a reconstituted tobacco sheet with an adhesive applied along the edge to provide a firm adhesion between the inner and outer surfaces of the sheet. U.S. Pat. No. 6,571,803 issued to Bregeard discloses a method for gumming a reconstituted tobacco leaf. Also, a machine for making paper booklets of interleaved cigarette paper is disclosed by Jones, U.S. Pat. No. 4,775,358. However, none of these references disclose a method for gumming a transparent cellophane wrapping paper or an adhesive suitable therefore.

Because the cellulose paper is nonabsorbent and the adhesive or standard acacia gum typically used with rolling papers has high water content, the standard adhesives run off of cellulose paper as soon as they are applied. Furthermore, applying such adhesive or gum causes the cellulose sheet to warp and the ends of the cellulose sheet to curl. A further problem posed by adhesives and acacia gums is that they are also transparent in appearance. As a result, the high transparency of the adhesive makes it difficult for the consumer to determine which edge of the transparent paper has adhesive applied and thus, which edge should be moistened to seal the roll of smoking materials.

Accordingly, the present invention provides a secure closure for the package which contains the interleaved papers, as well as a tamper-resistant seal for keeping the papers secure until the package is opened by the smoker. Another feature of the present invention is that the cellulose papers are interleaved for convenient removal from the package. The adhesive utilized not only successfully adheres to the sheets but also allows each sheet to be removed from the booklet without damaging the adhesive, which can be effectively retained on the sheet. As will be described in further detail below, such adhesive is preferably cellulose-based, but may comprise other suitable adhesives which embody the aforementioned desirable qualities.

SUMMARY OF THE INVENTION

Therefore, one object of the present invention is to provide a secure closure for the package which contains the interleaved papers, as well as a tamper-resistant seal for keeping the papers secure until the package is opened by the smoker.

These and other objects, features, and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present inventions, reference should be made to the following detailed disclosure, taken in conjunction with the accompanying drawings, in which like parts are given like reference numerals, and wherein.

DETAILED DESCRIPTION OF THE PREFERRED EMBODIMENTS

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto to be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

Figure 1:
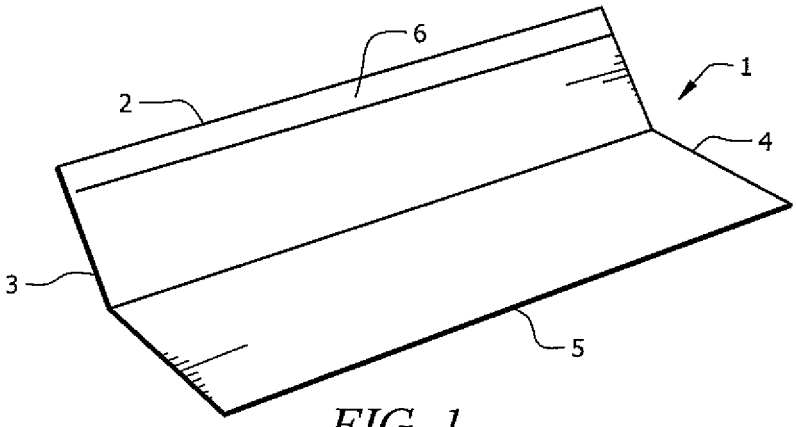
FIG. 1 is a perspective view of a gummed cellulose paper.

Turning now to FIG. 1, a highly transparent cellulose paper 1 is shown. Each flat sheet of paper 1 is cut so that it has four edges 2-5. A strip of adhesive 6 is applied to a top edge 2, wherein the weight of the adhesive gumline is in the range of 20-110 grams per square meter (gsm). In a preferred embodiment, the adhesive 6 is cellulose-based, although other adhesives may also be used which satisfy the requirements of adhering to the cellulose paper 1, such as a non-standard formulation containing acacia gum, sugar gum, or animal gum. The cellulose-based adhesive is preferably comprised of ninety-seven percent water, two percent cellulose gum, and one percent flavoring. Optionally, a pigment or food coloring is also added to create an opacity when dry so that the adhesive line can be seen on the paper 1. The components are preferably food grade and the amounts may be adjusted accordingly if it is desired to eliminate the flavoring. The source of the cellulose gum in the cellulose based adhesive is preferably sodium carboxymethylcellulose. In a preferred embodiment, the adhesive strip 6 is opaque so that the smoker can detect which edge of the highly transparent sheet 1 has adhesive and hence, which edge should be moistened to seal the smoking article.

Figure 2:
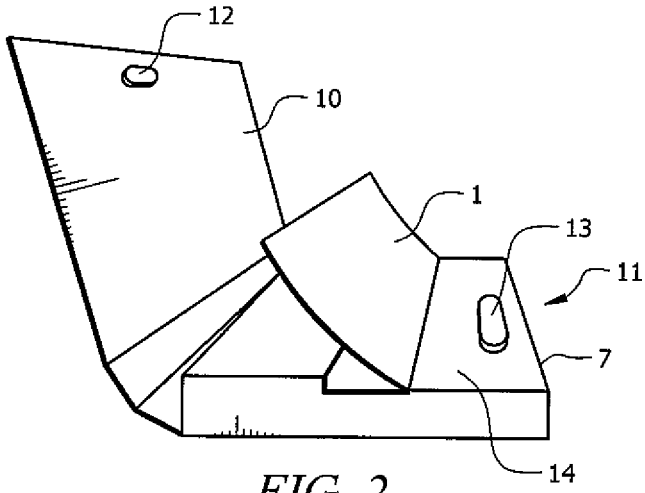
FIG. 2 is a perspective view of a package containing interleaved rolling papers which are individually removable, and which package includes a magnetic closure.

FIG. 2 shows a plurality of cellulose papers 1 in a reclosable package 7. In a preferred embodiment, the cellulose sheets 1 are interleaved 8, best shown in FIG. 3, so that the papers can be individually removed from the package 7 through an open slot 9. When not in use, package 7 includes a cover 10 which can be closed to protect the papers 1 contained therein. The package 7 may be made of a stiff paper or cardboard material or a thin plastic.

Figure 3:
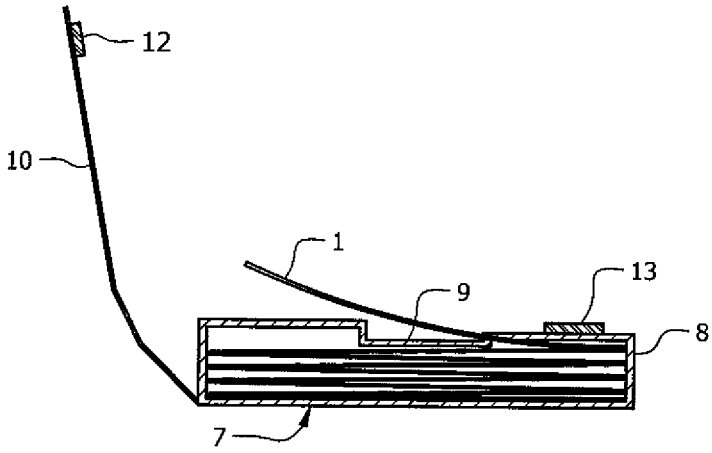
FIG. 3 is a sectional elevation view of the package of FIG. 2 showing the interleaved papers.

FIGS. 2 and 3 also show the package 7 having a secure closure means comprising a magnet-based closure 11. In an embodiment, a first magnet 12 is located on the inside cover 10 of the package 7. A second magnet 13 is located on the body 14 of package 7. The second magnet 13 may be located on an inside or outside surface of the body 14. Alternatively, the first magnet 12 may be located on the body 14 of the package 7, and the second magnet 13 may be located on the inside cover 10 of the package 7.

The magnets 12, 13 are positioned to contact one another when the cover 10 is folded downwardly to create a secure closure. In a preferred embodiment, the first magnet 12 is made of a magnetic metallic material, and the second magnet 13 is made of a magnetic composite material. Alternatively, the first magnet 12 may be made of a magnetic composite material, and the second magnet 13 may be made of a metallic material. Alternatively, one magnet could be made of a magnetic material, and the other magnet could be made of a metallic material (e.g., base iron). However, eventually the magnetic material will magnetize the metallic material.

Further, although a single magnet pair 12, 13 is shown in the center of package 7, a plurality of magnets may also be employed, such as two pairs of magnets, with each pair at the corners of cover 10 and body 14. Alternate embodiments may include different fastening means to hold the package closed, such as a gummed or adhesive strip, a hoof and loop fastener, or similar closure.

In an embodiment, the magnetic metallic material and the magnetic composite material may be any suitable shape, size and thickness. In a preferred embodiment, the magnetic metallic material is about 6.12 mm in diameter, and about 0.55 mm in thickness, and the magnetic composite material is about 5.00 mm in diameter, and about 0.76 mm in thickness.

In an embodiment, the second magnet 13 moves gradually inward relative to its original position in the full package as papers 1 are removed from the package. In a preferred embodiment, the second magnet 13 is about 5.47 mm from an approximately parallel rear surface of the body 14 in the full package, and about 5.29 mm from the rear surface in the empty package. Accordingly, the magnet 13 moves inward about 0.18 mm during use.

In an embodiment, the magnetic material may be any suitable material that produces a persistent magnetic field in the absence of an applied magnetic field. For example, suitable magnetic materials include: magnetic metallic elements magnetic composites. The magnetic metallic elements include: iron, cobalt, nickel, and combinations thereof. The magnetic composites include: ceramic or ferrite magnets such as a sintered composite of powdered iron oxide and barium/strontium carbonate ceramic, alnico magnets such as a sintered composite of aluminum, nickel and cobalt, triconal magnets such as alloys of titanium, cobalt, nickel and aluminum, rare earth magnets such as samarium-cobalt and neodymium-iron-boron (NIB) magnets, and combinations thereof. In a particularly preferred embodiment, the magnetic material is a sintered composite of neodymium, iron and boron to form the $Nd_2Fe_{14}B$ tetragonal crystalline structure that is currently the strongest type of magnet.

Some magnetic properties used to compare permanent magnets are remanence ($M_r$), the strength of the magnetic field, coercivity ($H_{eb}$), the materials resistance to becoming demagnetized, inner coercivity ($H_{ci}$), the material's inner resistance to becoming demagnetized, energy product ($BH_{max}$), the density of the magnetic energy, Curie temperature ($T_c$), the temperature at which the material loses its magnetism. Table 1 shows general magnetic properties for some common magnetic materials, and Table 2 shows specific magnetic properties for a preferred NIB magnetic material.

TABLE 1

General Magnetic Properties For Some Magnetic Materials

| Types of Permanent Magnets | Magnet Material | $M_r$ (T) | $H_{ci}$ (kA/m) | $BH_{max}$ (kJ/m3) | $T_c$ (° C.) |
|---|---|---|---|---|---|
| Ferrite | Sr-ferrite (sintered) | 0.2-0.4 | 100-300 | 10-40 | 450 |
| Alnico | Alnico | 0.6-1.4 | 275 | 1-88 | 700-860 |

TABLE 1-continued

General Magnetic Properties For Some Magnetic Materials

| Types of Permanent Magnets | Magnet Material | $M_r$ (T) | $H_{ci}$ (kA/m) | $BH_{max}$ (kJ/m3) | $T_c$ (° C.) |
|---|---|---|---|---|---|
| | (sintered) | | | | |
| Rare Earth | $SmCo_5$ (sintered) | 0.8-1.1 | 600-2000 | 120-200 | 720 |
| | $Nd_2Fe_{14}B$ (sintered) | 1.0-1.4 | 750-2000 | 200-440 | 310-400 |
| | $Nd_2Fe_{14}B$ (bonded) | 0.6-0.7 | 600-2000 | 60-100 | 310-400 |

TABLE 2

Specific Magnetic Properties For A Preferred NIB Magnetic Material

| Type | Magnet Material | $M_r$ (T) | $H_{cb}$ (kA/m) | $H_{ci}$ (kA/m) | $BH_{max}$ (kJ/m3) | $T_{operation}$ (° C.) |
|---|---|---|---|---|---|---|
| Rare Earth | $Nd_2Fe_{14}B$ (sintered)[1] | 1.17-1.21 | 868 | 955 | 263-287 | 80 |

[1]The preferred NIB magnetic material may have a superficial treatment of Zinc, and an axial magnetization where one site pole is North[1] and the other site pole is South.
[1]When a magnet is freely suspended, the magnet's North pole points towards the Earth's magnetic North pole in northern Canada.

Figure 4:
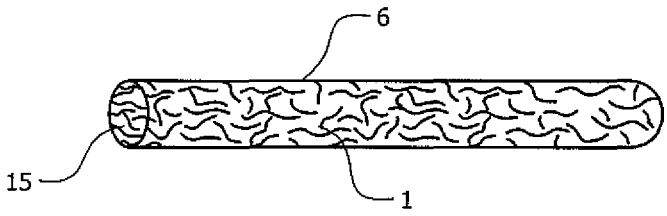
FIG. 4 is a view of a rolled smoking article using the present invention.

FIG. 4 depicts a cellulose sheet 1 wrapped around the desired smoking materials 15, e.g. loose tobacco. The cellulose sheet 1 is highly transparent so that the smoking materials 15 are visible through sheet 1. The strip of opaque adhesive 6 allows the smoker to effectively circumscribe the smoking materials in the wrapping paper and to seal the article for smoking.

Figure 5:
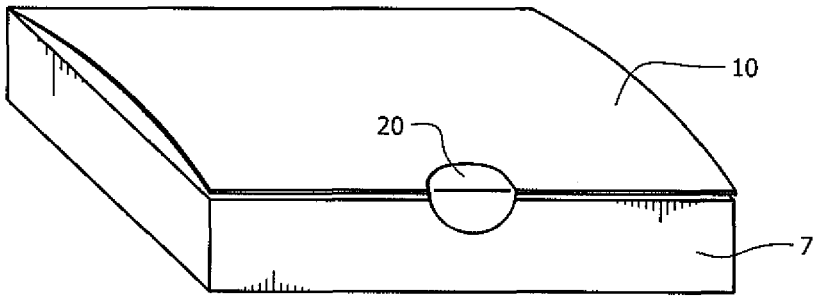
FIG. 5 is a perspective view of a package of rolling papers having a tamper-resistant seal when closed.

FIG. 5 depicts a closed package 7 having a tamper-resistant adhesive seal 20 affixed across the cover 10 when the package 7 is closed. The seal 20 allows the smoker to know that the package 7 is "factory fresh", and it can be easily removed to access the papers 1. In a preferred embodiment, the seal 20 may be a foil-type sticker adhesively applied by the manufacturer.

As can be seen for the foregoing description of the preferred and alternate embodiments, the present invention is intended to provide a highly transparent cellophane wrapping paper with a suitable adhesive so that it can easily be dispensed and used to securely wrap smoking materials. Also, a novel means of securing the closure of the package is provided. Although exemplary embodiments of the present invention have been shown and described, many changes, modifications, and substitutions may be made by one having ordinary skill in the art without necessarily departing from the spirit and scope of the invention.

As used herein, the terms "a," "an," "the," and "said" means one or more.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

The invention claimed is:

1. A recloseable smoking paper package for containing smoking papers to be dispensed therefrom, the smoking paper package comprising:

an enclosed body for holding the smoking papers, the body having a slot formed in a central area of a top surface of the body, a cover which overlays the body of the smoking paper package for closure, wherein the cover has a first magnet, wherein the body has a second magnet, the first and second magnets being positionally mounted to contact one another when the cover is folded downwardly over the body of the smoking paper package for closure and wherein the smoking paper package is made from paper or plastic; and a plurality of smoking papers disposed within the body of the smoking paper package, wherein the smoking papers are interleaved, each of the plurality of smoking papers having an adhesive strip formed on a top edge, the adhesive strip having an opacity to allow the adhesive strip to be visible, wherein each adhesive strip is required to be moistened to seal a corresponding smoking papers and is unfastened to an adjacent smoking paper;

wherein the enclosed body is constructed so the second magnet moves inwardly towards the slot as the plurality of smoking papers is removed.

2. The package of claim 1, further including a tamper-resistant seal adhesively applied across the cover and the body.

3. The package of claim 1, wherein either the first or the second magnet is a magnetic metallic material, and the other magnet is a magnetic composite material.

4. The package of claim 3, wherein the magnetic metallic material is selected from the group consisting of iron, cobalt, nickel and combinations thereof.

5. The package of claim 3, wherein the magnetic composite material is selected from the group consisting of magnetic metallic elements, ferrite magnets, alnico magnets, triconal magnets, rare earth magnets and combinations thereof.

6. The package of claim 3, wherein the magnetic composite material is a sintered Nd2Fel4B.

7. The package of claim 6, wherein the sintered Nd2Fe14B composite has a remanence of about 1.17 to 1.21 T, a coercivity of about 850 to 980 kAim and a energy product of about 250 to 300 kJ/m3.

8. The package of claim 1, wherein the first and the second magnets are about 4.5 to 6.5 mm in diameter.

9. The package of claim 1, wherein the first and the second magnets are about 0.5 to 0.8 mm in thickness.

10. A recloseable smoking paper package for containing smoking papers to be dispensed therefrom, the smoking paper package comprising:

an enclosed body for holding the smoking papers, the body having a slot formed in a central area of a top surface of the body, a cover which overlays the body of the smoking paper package for closure, wherein the cover has a first magnet, wherein the body has a second magnet, the first and second magnets being positionally mounted to contact one another when the cover is folded downwardly over the body of the smoking paper package for closure and wherein the smoking paper package is made from paper or plastic; and a plurality of smoking papers disposed within the body of the smoking paper package, wherein the smoking papers are interleaved, the slot allowing for the disposal of a top most smoking paper while keeping remaining smoking papers within the body, each of the plurality of smoking papers having an adhesive strip formed on a top edge, the adhesive strip having an opacity to allow the adhesive strip to be visible, wherein each adhesive strip is required to be moistened to seal a corresponding smoking papers and is unfastened to an adjacent smoking paper;

wherein the enclosed body is constructed so the second magnet moves inwardly towards the slot as the plurality of smoking papers is removed.

* * * * *